US005121843A

United States Patent [19]

Elder

[11] Patent Number: 5,121,843

[45] Date of Patent: Jun. 16, 1992

[54] RESTRAINING NET FOR DISHES

[76] Inventor: Shirley A. Elder, 11 Pinecrest Dr., Huntsville, Tex. 77340

[21] Appl. No.: 692,915

[22] Filed: Apr. 29, 1991

[51] Int. Cl.[5] ..... A47L 15/42

[52] U.S. Cl. ..... 211/41; 134/201

[58] Field of Search ..... 134/201, 135; 211/41, 211/181; 383/117; 224/314, 318, 328

[56] References Cited

U.S. PATENT DOCUMENTS 3,982,799 9/1976 Murray ..... 312/270
4,047,550 9/1977 Scholz ..... 383/117 X
4,366,949 1/1983 Staub, Sr. ..... 383/117 X
4,832,206 5/1989 Cunningham ..... 211/41
4,974,806 12/1990 Matern ..... 211/41 X

*Primary Examiner*—Philip R. Coe
*Attorney, Agent, or Firm*—Bill B. Berryhill

[57] ABSTRACT

A restraining net for restraining dishes in a dishwasher comprising a generally convex net the peripheral edges of which correspond with the periphery of a dishwasher rack with which it is to be used. Fasteners are provided for fastening the periphery of the net around the periphery of the dishwasher rack.

3 Claims, 1 Drawing Sheet

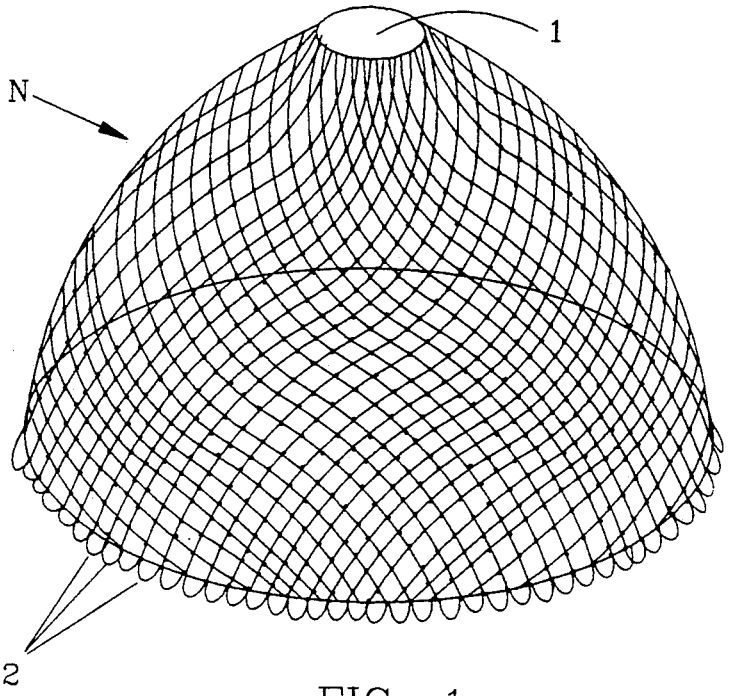
FIG. 1
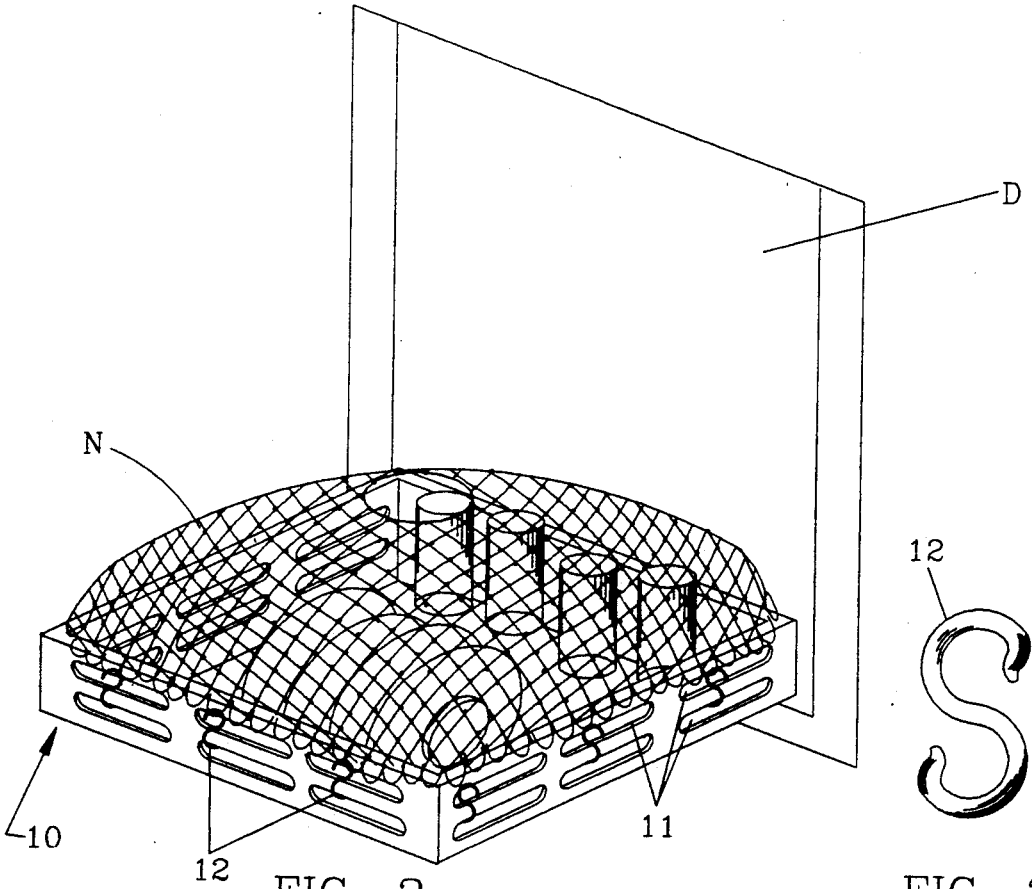
FIG. 2
FIG. 3

RESTRAINING NET FOR DISHES

BACKGROUND OF THE INVENTION

1. Field of the Invention

The present invention pertains to restraining nets. More specifically, the present invention pertains to a restraining net for restraining dishes in a dishwasher.

2. Description of the Prior Art

Most automatic dishwashers have one or more racks in which dishes are placed for washing. These racks usually pull out for loading. When the racks are loaded with dishes, they are pushed back into the dishwasher and the washing cycle initiated.

Frequently, dishes in a dishwasher become dislodged and repositioned by the water pressure therein and many times the dislodged dish will be in a position to fill with water which remains therein throughout the entire cycle. Not only does the dislodged item remain filled with unclean water during the washing cycle, it is likely that when the dishwasher is opened, the rack pulled out and the dishes unloaded, the unclean water from the dislodged dish will spill onto clean dishes.

Another problem with unrestrained dishes in an automatic dishwasher is the noise created thereby. Dishes dislodged from their original position may be tossed about banging against other dishes. In addition, small and/or light plastic items are frequently dislodged by water pressure sometimes coming to rest on or near the heating element of a dishwasher where they may be melted or reshaped so as to be rendered unusable.

Manufacturers of dishwashers have recognized the problems associated with unrestrained dishes in a dishwasher. Some have attempted to solve the problem with various types of restraining devices. For example, covered compartments may be provided for small items. However, most of the solutions to date are not totally satisfactory for dishes of all sizes. Thus, improvements are needed.

SUMMARY OF THE PRESENT INVENTION

In the present invention, a net type restrainer is provided for an automatic dishwasher which may be positioned over the dishes after they are loaded in the dishwasher rack. The net is preferably manufactured so as to attain a convex or dome-like disposition when it is placed over the dishes in the automatic dishwasher rack. Suitable fasteners are provided around the lower edge of the net by which the net is attached to the dishwasher rack. In a preferred embodiment, a central aperture is provided in the net so as not to interrupt the supply of water which, in some dishwashers, is sprayed upwardly through the center of a rack.

Thus, a primary object of the present invention is to provide a new and novel net for restraining dishes placed in the rack of an automatic dishwasher. The purpose of such an object is to prevent the dishes from being displaced and filled with contaminated water and to prevent their contaminating other dishes when taken out of the dishwasher.

Another object of the present invention is to prevent dishes from being tossed around in a dishwasher so as to produce unwanted noises and possible breakage. Still another object of the present invention is to prevent small and/or light plastic items from being dislodged so as to be permanently damaged by heating elements in the dishwasher. Many other objects and advantages of the invention will be apparent from reading the description which follows in conjunction with the accompanying drawings.

BRIEF DESCRIPTION OF THE DRAWINGS

FIG. 1 is a perspective view of a dish restraining net for restraining dishes in a dishwasher, according to a preferred embodiment of the invention;

FIG. 2 is a pictorial view of the rack of a dishwasher, shown loaded with dishes, and over which the restraining net of FIG. 1 has been placed; and FIG. 3 is a detailed view of a fastening device which may be used to attach a restraining net to a dishwasher rack, according to a preferred embodiment of the invention.

DESCRIPTION OF A PREFERRED EMBODIMENT

Referring first to FIG. 1, there is shown a net N for restraining dishes is a dishwasher, according to a preferred embodiment of the invention. The net may be made from any suitable net material or cord. Of course it is preferable that the material shed water for durability and cleanliness. If the net material is not water resistant, it should be coated with a water resistant material. The net should be slightly larger than the dishwasher rack with which it is to be used so that it may assume a convex or dome-like position, such as shown in FIGS. 1 and 2. Centrally located in the net N is an opening or aperture 1. The outer periphery of the net N terminates in a plurality of looped portions 2.

As illustrated in FIG. 2, dishes are first placed in the rack 10 of a dishwasher D. Most racks are provided with slots or holes 11 therearound. When the dishes are loaded in the rack, the net N is placed over the dishes and the periphery of the net N is fastened to the rack 10 by fasteners 12 such as S-hooks shown in FIG. 3. One of the hooks of fastener 12 may be hooked in an aperture 11 of the rack 10 and the opposing hook may be hooked in a loop 2 of the net N.

The central opening 1 is positioned for central disposition over the rack 10. This is particularly true in dishwashers of the type in which water is sprayed upwardly through the center of the dishwasher or in which a telescoping member projects upwardly through the center of the dishwasher for supplying water to the upper part of the dishwasher.

The net N, of course, is very flexible and conforms to the exposed surfaces of the dishes placed in the rack 10. However, the net N is of such size and shape that it holds the dishes snugly in place to prevent their being dislodged during the washing cycle. After the washing cycle is completed, and the rack 10 pulled out, the net is removed or partially removed to allow removal of the clean dishes. The cycle may then be repeated.

Thus, the present invention provides a dish restraining net which restrains dishes during the washing cycle to prevent their being filled with dirty water, making noise or being thrown against heating elements to cause permanent damage thereto. The net is extremely simple to manufacture and use as well as relatively cheap to manufacture and sell.

A single embodiment of the invention has been described herein. However, many variations of the invention may be made without departing from the spirit of the invention. Accordingly, it is intended that the scope of the invention be limited only by the claims which follow.

What is claimed is:

1. A dish restraining net for use with a dishwasher comprising: a net of net material having an outer periphery which generally conforms to outer edges of a dishwasher rack with which the net is to be used and fastener means for fastening said net periphery around said edges of said dishwasher rack, said net being convex or dome-like in shape so that when placed over dishes in said dishwasher rack and fastened to said rack, said net having at its center an opening substantially larger than any other openings through said net material, providing an unobstructed passage through said net.

2. A dish restraining net as set forth in claim 1 in which said outer periphery of said net is provided with a plurality of loops for engagement by said fastener means to attach the periphery of said net around said dishwasher rack.

3. A dish restraining net as set forth in claim 2 in which said fastener means comprises a plurality of hooks engaging said net loops and said rack for fastening said outer periphery of said net around said edges of said dishwasher rack.

* * * * *